United States Patent [19]

Burk, Jr. et al.

[11] 4,158,548

[45] Jun. 19, 1979

[54] PROCESS FOR REMOVING SULFUR FROM COAL

[75] Inventors: Emmett H. Burk, Jr., Glenwood; Jin S. Yoo, South Holland; John A. Karch, Chicago, all of Ill.

[73] Assignee: Atlantic Richfield Company, Philadelphia, Pa.

[21] Appl. No.: 886,976

[22] Filed: Mar. 15, 1978

Related U.S. Application Data

[63] Continuation-in-part of Ser. No. 726,082, Sep. 23, 1976, abandoned.

[51] Int. Cl.[2] ..... C10L 9/10; C10B 57/00

[52] U.S. Cl. ..... 44/1 R; 201/17

[58] Field of Search ..... 44/1 R; 201/17

[56] References Cited

U.S. PATENT DOCUMENTS

| | | | |
|---|---|---|---|
| 2,338,634 | 1/1944 | Fuchs | 44/1 R |
| 2,346,151 | 4/1944 | Burk et al. | 44/1 R |
| 3,824,084 | 7/1974 | Dillon et al. | 44/1 R |
| 3,988,120 | 10/1976 | Chia | 44/1 R |
| 3,993,456 | 11/1976 | Cole et al. | 44/1 R |

*Primary Examiner*—Carl Dees

*Attorney, Agent, or Firm*—John B. Goodman

[57] ABSTRACT

A process for reducing the pyritic sulfur content of coal comprising:

(1) contacting coal particles with an aqueous solution of iron complexing agent, and an oxidant; and;

(2) recovering coal particles of reduced sulfur content.

18 Claims, No Drawings

PROCESS FOR REMOVING SULFUR FROM COAL

RELATED APPLICATIONS

This application is a continuation-in-part of application Ser. No. 726,082, filed Sept. 23, 1976 and now abandoned.

BACKGROUND OF THE INVENTION

1. Field of the Invention

The field of this invention relates to a process for reducing the sulfur content of coal.

2. Prior Art

The problem of air pollution due to the emission of sulfur oxides when sulfur-containing fuels are burned has received increasing attention in recent years. It is now widely recognized that sulfur oxides can be particularly harmful pollutants since they can combine with moisture to form corrosive acidic compositions which can be harmful and/or toxic to living organisms in very low concentrations.

Coal is an important fuel, and large amounts are burned in thermal generating plants primarily for conversion into electrical energy. One of the principal drawbacks in the use of coal as a fuel is that many coals contain amounts of sulfur which generate unacceptable amounts of sulfur oxides on burning. For example, coal combustion is by far the largest single source of sulfur dioxide pollution in the United States at present, and currently accounts for 60 to 65% of the total sulfur oxide emissions.

The sulfur content of coal, nearly all of which is emitted as sulfur oxides during combustion, is present in essentially two forms: inorganic, primarily metal pyrites, and organic sulfur. The inorganic sulfur compounds are mainly iron pyrites, with lesser amounts of other metal pyrites and metal sulfates. The organic sulfur may be in the form of thiols, disulfide, sulfides and thiophenes (substituted, terminal and sandwiched forms) chemically associated with the coal structure itself. Depending on the particular coal, the sulfur content can be primarily in the form of either inorganic sulfur or organic sulfur. Distribution between the two forms varies widely among various coals.

In the United States, except for Western coals, the bulk of the coal produced is known to be high in pyrite. Both Appalachian and Eastern interior coals have been analyzed to be rich in pyritic and organic sulfur. Generally, the pyritic sulfur represents from about 25% to 70% of the total sulfur content in these coals.

Heretofore, it was recognized that it would be highly desirable to remove (or at least lower) the sulfur content of coal prior to combustion. A number of processes, for example, have been suggested for removing the inorganic (pyritic) sulfur from coal.

For example, it is known that at least some pyritic sulfur can be physically removed from coal by grinding the coal, and subjecting the ground coal to froth flotation or washing processes. While such processes can desirably remove some pyritic sulfur, these processes are not fully satisfactory because a significant portion of the pyritic sulfur is not removed. Attempts to increase the portion of pyritic sulfur removed have not been successful because these processes are not sufficiently selective. Because the process is not sufficiently selective, a large portion of coal can be discarded along with ash and pyrite.

There have also been suggestions heretofore to chemically remove sulfur from coal. For example, U.S. Pat. No. 3,768,988 to Meyers, issued Oct. 30, 1973, discloses a process for reducing the pyritic sulfur content of coal involving exposing coal particles to a solution of ferric chloride. The patent suggests that in this process ferric chloride reacts with pyritic sulfur to provide free sulfur according to the following reaction process:

$$2FeCl_3+FeS_2\rightarrow 3FeCl_2+S$$

While this process is of interest, a disadvantage of this process is that the liberated sulfur solids must then be separated from the coal solids. Processes involving froth flotation, vaporization and solvent extraction are proposed to separate the sulfur solids. All of these proposals, however, inherently represent a second discrete process step with its attendant problems and cost which must be employed to remove the sulfur from coal.

In another approach, U.S. Pat. No. 3,824,084 to Dillon issued July 16, 1974, discloses a process involving grinding coal containing pyritic sulfur in the presence of water to form a slurry, and then heating the slurry under pressure in the presence of oxygen. The patent discloses that under these conditions the pyritic sulfur (for example, $FeS_2$) can react to form ferrous sulfate and sulfuric acid which can further react to form ferric sulfate. The patent discloses that typical reaction equations for the process at the conditions specified are as follows:

$$FeS_2H_2C+7/2O_2\rightarrow FeSO_4+H_2SO_4$$

$$2FeSO_4+H_2SO_4+\tfrac{1}{2}O_2\rightarrow Fe_2(SO_4)_3+H_2O$$

These reaction equations indicate that in this particular process the pyritic sulfur content continues to be associated with the iron as sulfate. While it apparently does not always occur, a disadvantage of this is that insoluble material, basic ferric sulfate, can be formed. When this occurs, a discrete separate separation procedure must be employed to remove this solid material from the coal solids to adequately reduce sulfur content. Several other factors detract from the desirability of this process. The oxidation of sulfur in the process does not proceed at a rapid rate, thereby limiting output for a given processing capacity. In addition, the oxidation process is not highly selective such that considerable amounts of coal itself can be oxidized. This is undesirable, of course, since the amount of coal recovered from the process is decreased.

Numerous other methods have been proposed for reducing the sulfur content of coal. For example, U.S. Pat. No. 3,938,966, to Kindig et al issued Feb. 17, 1976, discloses treating coal with iron carbonyl to enhance the magnetic susceptibility of iron pyrites to permit removal with magnets. In summary, while the problem of reducing the sulfur content of coal has received much attention, there still exists a present need for a practical method to more effectively reduce the sulfur content of coal.

SUMMARY OF THE INVENTION

This invention provides a practical method for more effectively reducing the sulfur content of coal. In summary, this invention involves a process for reducing the pyritic sulfur content of coal comprising:

(1) contacting coal particles with an aqueous solution of iron complexing agent and an oxidant; and (2) recovering coal particles of reduced sulfur content.

It has now been discovered that contacting coal containing pyritic sulfur with an aqueous solution containing an iron complexing agent and an oxidant provides faster reaction rates (reducing processing time), more selective oxidation of sulfur compounds, and with some coals, some organic sulfur removal. These desirable attributes are important, and are made available in the process of this invention.

DETAILED DESCRIPTION OF THE INVENTION AND ITS PREFERRED EMBODIMENTS

In its broad aspect, this invention provides a method for reducing the pyritic sulfur content of coal by a process comprising:

(1) contacting coal particles with an aqueous solution of iron complexing agent and an oxidant; and (2) recovering coal particles of reduced sulfur content.

The novel process of this invention is especially effective for reducing the pyritic sulfur content of coal. An advantage of the process is that it can also provide a reduction in the organic sulfur content of some coals. A further advantage of the process is that the ash content of the coal is reduced.

Suitable coals which can be employed in the process of this invention include brown coal, lignite, subbituminous, bituminous (high volatile, medium volatile, and low volatile), semi-anthracite, and anthracite. Regardless of the rank of the feed coal, excellent pyrite removal can be achieved by the process of this invention. Metallurgical coals, and coals which can be processed to metallurgical coals, containing sulfur in too high a content, can be particularly benefited by the process of this invention.

The coal particles employed in this invention can be provided by a variety of known processes, for example, grinding.

The particle size of the coal can vary over wide ranges and in general the particles need only be sufficiently small to enhance contacting with the aqueous medium. For instance, the coal may have an average particle size of one-fourth inch in diameter or larger in some instances, and as small as minus 200 mesh (Tyler Screen) or smaller. The most practical particle size is often minus 5 mesh, preferably minus 18 mesh, as less energy is required for grinding and yet the particles are sufficiently small to achieve the optimum rate of pyrite removal.

Iron complexing agents which promote selective oxidation and removal of pyritic sulfur, and do not have an adverse effect on the coal, are used in the process of this invention.

The most suitable amount of iron complexing agent employed depends upon the pyrite and ash content of the coal, and the complexing agent employed. A mole ratio of complexing agent to pyrite of from about 0.05 to 10, and preferably 1.0 to 6.0, can be suitably employed. It is generally convenient to employ aqueous solutions of iron complexing agent which are from about 0.05 to about 1.0 molar, preferably 0.05 to 0.3 molar with respect to iron complexing agent.

Suitable iron complexing agents for use in this invention are compounds which can complex ferrous and/or ferric ions. Preferred complexing agents are compounds which can form ferrous complexes or ferric complexes having a stability constant of $-\log K$ greater than 1, and preferably greater than 2.0.

Convenient compilations providing stability constants of many complexing agents for iron are Martell and Calvin, "Chemistry of the Metal Chelate Compounds", U.S. copyright 1952, and "Stability Constants of Metal-Iron Complexes," Supplement No. 1, Special Publication No. 25, published by The Chemical Society, U.S. copyright 1971.

Examples of suitable iron complexing agents include the following: carboxylic acids and carboxylic acid salts, for example, oxalic acid, malonic acid, succinic acid, citric acid, tartaric acid, lactic acid, gluconic acid, salicylic acid, and salts thereof; diols and polyols, for example, glycol, glycerol, butane-1,3 diol, mannitol, sorbitol, glucose, lactose, fructose and sucrose; amines, for example, ethylenediamine, diethylenetriamine and triethylenetetramine; amino acids, for example, glycine, and asparagine and salts thereof; amino polycarboxylic acids and amino polycarboxylic acid salts, for example, N-hydroxyethyl-iminodiacetic acid, nitrilotriacetic acid, N,N-di (2-hydroxyethyl) glycine and N,N,N',N'-ethylenediaminetetraacetic acid and salts thereof; phosphonic acids and phosphonic acid salts, for example, ethane-1-hydroxy-1,1-diphosphonic acid; and condensed phosphates, for example, trimetaphosphoric acid, tripolyphosphoric acid and salts thereof. Mixtures of complexing compounds can be very desirably employed.

As will be recognized by those skilled in the art, the stability of the ferrous and ferric complexes formed will often be affected by the pH of the aqueous medium. In such cases, it is contemplated that the pH will be such that a stability constant $-\log K$ greater than 1 is maintained and more preferably, the optimum pH for the particular complexing agent will be maintained. The particular pH employed can also affect the salt form of the complexing agent employed, and such salts are complexing agents within the scope of this invention.

Many of the complexing agents useful in the process of this invention can be very desirably formed in situ prior to or in the course of the process. For example, cellulosic materials can be oxidized to form a complex mixture of polyols, hydroxy carboxylic acids, carboxylic acids and corresponding acid salts which can provide a complexing solution meeting the requirements of this invention. (Any aqueous solution of complexing agents which complexes the iron in coal satisfies the requirements of this invention).

Oxalic acid salts, for example, sodium, potassium and ammonium oxalate are preferred complexing agents for use in the process of the invention in that they are effective complexing agents which are readily available and inexpensive.

Suitable oxidants for use in this invention are those oxidants which preferentially oxidize the sulfur contained in the coal rather than the carbon portion of the coal. By this is meant that the oxidation of sulfur atoms occurs without substantial oxidation of carbon atoms to form, for example, ketones, carboxyl acids or other carbonyl-containing compounds, carbon monoxide and carbon dioxide. This preferential oxidation, or selectivity is important in maintaining the heat content of the coal.

Included among the oxidants which are useful herein are organic oxidants and inorganic oxidants.

The organic oxidants include by way of example hydrocarbon peroxides, hydrocarbon hydroperoxides and hydrocarbon peracids wherein the hydrocarbon radicals in general contain from about 1 to about 30 carbon atoms per active oxygen atom. With respect to the hydrocarbon peroxides and hydrocarbon hydroperoxides, it is particularly preferred that such hydrocarbon radical contain from about 4 to about 18 carbon atoms per active oxygen atom, i.e., per peroxide linkage, and more particularly from 4 to 16 carbon atoms per peroxide linkage. With respect to the hydrocarbon peracids, the hydrocarbon radical is defined as that radical which is attached to the carbonyl carbon and it is preferred that such hydrocarbon radical contain from 1 to about 12 carbon atoms, more preferably from 1 to about 8 carbon atoms, per active oxygen atom. It is intended that the term organic peracid include, by way of definition, performic acid. It is contemplated within the scope of this invention that the organic oxidants can be prepared in situ.

Typical examples of organic oxidants are hydroxyheptyl peroxide, cyclohexanone peroxide, t-butyl peracetate, di-t-butyl diperphthalate, t-butyl-perbenzoate, methyl ethyl ketone peroxide, dicumyl peroxide, t-butyl hydroperoxide, di-t-butyl peroxide, pinane hydroperoxide, 2,5-dimethylhexane-2,5-dihydroperoxide, tetrahydronaphthalene hydroperoxide and cumene hydroperoxide as well as organic peracids, such as performic acid, peracetic acid, trichloroperacetic acid, perbenzoic acid and perphthalic acid.

Inorganic oxidants include by way of example, oxygen, singlet oxygen, ozone, peroxides and superoxides. Typical examples of inorganic peroxides are $H_2O_2$, $KMnO_4$, $KO_2$, $Na_2O_2$ and $Rb_2O_2$; typical examples of inorganic superoxides are $KO_2$, $RbO_2$, $CsO_2$, $Na_2SO_5$ and $Na_2S_2O_8$.

Oxygen is a preferred oxidant.

In general, the mole ratio of oxidant to pyritic sulfur is from about 0.5 to about 10 atoms of active (i.e., reducable) oxygen per atom of sulfur. More or less oxidant could be employed, however. The most effective oxidation will generally occur when the mole ratio oxidant to pyritic sulfur is greater than about 4, for example, when 5 to 10, atoms of active oxygen per atom of sulfur are present.

The preferred oxidant, oxygen, can be present as pure oxygen gas or it can be mixed with other inert gases. For example, air or air enriched with oxygen can be suitably employed as a source of gaseous oxygen. Preferably, the gaseous oxygen is above atmospheric pressure, for example, pressures of from about 5 to 500 psig., preferably 25 to 400 psig., and more preferably from about 50 to 300 psig. If the oxygen is mixed with other gases, the partial pressure of oxygen is most suitably within the pressure ranges mentioned hereinbefore.

Elevated temperatures can be desirably employed to accelerate the process. For example, temperatures of from about 150° to 500° F., preferably from about 150° to 400° F., and more preferably from about 175° to about 350° F., can be suitably employed. Under these reaction conditions, the pyritic sulfur can be preferentially oxidized without significant adverse oxidation of the coal substrate.

Under these conditions, pyritic sulfur is readily removed from the coal. It is believed that removal involves oxidation of the pyritic sulfur to sulfate, thionate and thiosulfate forms. As the reaction proceeds, oxidant is consumed. Additional oxidant can be added to the system if necessary.

The coal should be held under these conditions for a period of time sufficient to effect a significant reduction in the pyritic sulfur content, i.e., a reduction of at least 25%, and more preferably, a reduction of from 70% to 95% or more, by weight, of pyritic sulfur. Generally, a time period in the range of from about 5 minutes to 5 hours, or more, can be satisfactorily employed. Preferably, a time period of from 10 minutes to 2 hours is employed. During this time, it can be desirable to agitate the coal slurry. Known mechanical mixers, for example, can be employed to agitate the slurry.

It has been found that the presence of iron complexing agent provides faster reaction rates, i.e., faster removal of pyritic sulfur, and more selective oxidation. Depending upon the complexing agent employed, these desirable results can be optimized by adjusting the pH to an optimum sulfur removal range. For example, a pH of from about 4.0 to 7.0 is preferred, when the complexing agent of oxalic acid, and its corresponding salts, for example, sodium, potassium, and ammonium salts.

When the pyritic sulfur in coal is oxidized in the process of this invention, sulfur acids, for example, sulfuric acid, can be formed. If the pyritic sulfur content of the coal is high and/or the amount of aqueous solution in the coal slurry low, it can often be necessary to add a basic material to maintain a desired pH. On the other hand, depending on the complexing agent, the character and content of ash in the coal, it may be necessary to add an acidic material to maintain a desired pH.

It will be recognized by those skilled in the art that there are many ways to maintain the pH of the aqueous slurry within the desired range. For example, the pH of the slurry can be continuously monitored using commercially available pH meters, and a suitable quantity of basic or acidic material can be metered to the slurry as needed to maintain the desired pH. Another suitable method to obtain a pH in the desired range involves adding an appropriate amount of basic or acidic material to the aqueous slurry of coal and water prior to subjecting the slurry to the reaction conditions involving increased temperature and pressure.

Examples of suitable basic materials include alkali and alkaline earth metal hydroxides such as sodium hydroxide, potassium hydroxide, calcium hydroxide, magnesium hydroxide and their corresponding oxides. Other suitable basic materials include alkali and alkaline earth carbonates, such as sodium carbonate, sodium bicarbonate, potassium bicarbonate, ammonia, ammonium bicarbonate and ammonium carbonate. Among these basic materials, sodium hydroxide, sodium bicarbonate, potassium bicarbonate and ammonium bicarbonate are preferred.

An especially suitable acidic material is carbon dioxide. Other known acidic materials, of course, can be employed.

Materials which are buffering agents can be a very useful aid in maintaining the desired pH. An example of a suitable buffering agent is sodium acetate. As oxidation of the pyritic sulfur proceeds to generate sulfuric acid, part of the sodium acetate is converted to acetic acid to yield a buffer mixture, sodium acetate and acetic acid, in situ in the reactor. Control of pH within a very narrow range can be achieved using such a buffering agent. Other buffering agents for maintaining a desired pH are known to those skilled in the art.

It will be recognized by those skilled in the art that many complexing agents suitable for use in the process of this invention are also buffering agents. For example, many carboxylic acid salts and aminocarboxylic acid salts can find use as both complexing agents and buffering agents in the process. (As will also be recognized by those skilled in the art, depending upon the pH such complexing/buffering agents will be present as a mixture of acid and salt forms). Oxalic acid salts, for example, sodium, potassium and ammonium oxalate are illustrative of preferred complexing/buffering agents employed in the process of this invention.

The most suitable basic materials for maintaining the pH of the aqueous solution in the process are those having cations which form soluble salts with sulfur-oxygen anions such as thiosulfate, sulfate and thionate. The most suitable basic materials have anions comprising sodium, ammonium and/or potassium since such materials are readily available and form water soluble materials with sulfate.

Preferably the coal particles are contacted with the aqueous solution of iron complexing agent by forming a slurry of the solution and coal particles. The slurry can be formed, for example, by grinding coal in the presence of water and adding a suitable amount of iron complexing agent and oxidant or an aqueous solution of iron complexing agent and/or oxidant can be added to coal particles of a suitable size. Preferably, the slurry contains from about 5 to about 50%, by weight of the slurry, coal particles and more preferably from about 10 to about 30%, by weight of the slurry, coal particles.

From about 0.01 to 1%, by weight of coal, of a wetting agent can be a useful addition to the slurry. Suitable wetting agents include anionic, nonionic and amphoteric surfactants.

When coal particles are contacted with the aqueous solution of iron complexing agent and oxidant in accordance with this process, most of the pyritic sulfur and some organic sulfur, can be oxidized to form water separable sulfur compounds, for example, water soluble sulfate salts.

This water, containing dissolved sulfur compounds, is separated from the coal particles. Such a liquids-solids separation is relatively simple, and can be effected in a variety of ways. Filtering with bar sieves or screens, or centrifuging, for example, can be employed to separate the coal and water.

The resulting coal product has a substantially reduced pyritic sulfur content and can exhibit a diminished organic sulfur content. Preferably, the coal is dried prior to use or storage.

The water separated from the coal, containing dissolved sulfur compounds, can be discarded or more preferably, is treated to remove the sulfur content. The sulfur content can be removed, for example, by treating the water with compounds which form insoluble compounds with the oxidized sulfur compound. Preferably, the sulfur content is concentrated prior to such treatment, for example, by evaporating a portion of the water. For example, barium chloride added to concentrated water solutions of sulfate compound will form insoluble barium sulfate which will precipitate from the water solution. The precipitate and water can be separated by conventional methods, such that the resulting water is substantially free of sulfate content.

The following specific embodiments are provided to more specifically illustrate the invention described herein.

EXAMPLE I

West Virginia Peerless Seam coal was ground and screened to provide a quantity of coal having a particle size of less than 100 mesh. The feed coal had the following analysis:

| Percent by Weight | Wet Basis | Dry Basis |
|---|---|---|
| Sulfate sulfur | 0.01 | 0.01 |
| Pyritic sulfur | 1.82 | 1.84 |
| Organic sulfur | 1.35 | 1.37 |
| Total Sulfur | 3.18 | 3.22 |
| Ash | 8.11 | 8.20 |
| Water | 1.12 | — |

The coal was treated in the following manner to reduce its sulfur content. Thirty grams (wet basis) of this coal and 200 ml. of an aqueous solution of iron complexing agent (0.1 M sodium oxalate) were charged to an autoclave forming a slurry. The autoclave was sealed and then heated to 250° F.; oxygen was then introduced to the autoclave and maintained at a pressure of 300 psig $O_2$. The coal was held under these conditions for one hours, and then filtered to separate the coal and the aqueous solution. The coal was then dried. In the course of the reaction of pH of the slurry fell from 7.6 to 4.50.

The weight of the coal product recovered was 27.7 grams (93% recovery). This high recovery is indicative of the high selectivity of the process.

The recovered coal product had the following analysis:

| Percent by weight | Dry Basis |
|---|---|
| Sulfate sulfur | 0.028 |
| Pyritic sulfur | 0.18 |
| Organic sulfur | 1.19 |
| Total sulfur | 1.40 |
| Ash | 6.51 |
| Water | — |

The sulfur content of the coal was significantly reduced: 90% of the pyritic sulfur was removed, and 13% of the organic sulfur was removed. (As used herein, organic sulfur includes any elemental sulfur present). A further advantage of the process of this invention is that the ash content of the coal was reduced. The recovered coal product is highly improved in that it has a lower sulfur and ash content.

EXAMPLE II

When, in Example I the following coals are employed, the aqueous solution of iron complexing agent is 0.16 M sodium oxalate, the pH is maintained at 4.5–5.0, the temperature is 250° F., the oxygen pressure is 300–350 psig. $O_2$ and the time is 1 to 1½ hours, the following results presented in Table I, are obtained:

TABLE I

| Coal | | Percent Sulfur in Coal* | | | | Percent Removal of Sulfur | | | Percent Ash in Coal |
|---|---|---|---|---|---|---|---|---|---|
| | | Total | Sulfate | Pyrite | Organic | Total | Pyrite | Organic | |
| West. Va. Upper | Feed | 5.13 | .36 | 3.41 | 1.36 | — | — | — | 28.3 |

TABLE I-continued

| Coal | | Percent Sulfur in Coal* | | | | Percent Removal of Sulfur | | | Percent Ash in Coal |
|---|---|---|---|---|---|---|---|---|---|
| | | Total | Sulfate | Pyrite | Organic | Total | Pyrite | Organic | |
| Freeport | Treated | 1.42 | .12 | .15 | 1.15 | 72.3 | 95.6 | 15.5 | 24.3 |
| Upper Freeport | Feed | 4.44 | .14 | 3.13 | 1.17 | — | — | — | 17.4 |
| Somerset County, Pa. | Treated | .70 | .05 | .09 | .56 | 84.2 | 97.1 | 52 | 14.4 |
| Pittsburgh Coal Bed | Feed | 6.65 | .12 | 4.17 | 2.36 | — | — | — | 14.2 |
| Belmont County, Ohio | Treated | 2.03 | .01 | .17 | 1.86 | 69 | 94 | 21 | 8.73 |
| Pocahontas #4 Seam | Feed | 1.17 | .01 | .38 | .78 | — | — | — | 10.8 |
| Gary, W. Va. | Treated | .82 | .01 | .03 | .78 | .48 | 92.2 | 0 | 9.42 |

*Dry Ash Free Basis means organic sulfur; pHi means initial pH and pHf means final pH.

TABLE II

| Example | Coal Source and Amount | Complexing Agent and Amount | Process Conditions | | Percent Sulfur in Coal* | | | | Percent Removal | | | |
|---|---|---|---|---|---|---|---|---|---|---|---|---|
| | | | | | | | P.S. | O.S. | T.S. | P.S. | O.S. | Ash |
| V | Iowa, Mahaska County (46g) | EDTA[1] (36g) | 260° F.; 300 psig. $O_2$; 1 Hr.; Base: None - pHi-pHf (9.0–7.0) | Feed | 8.43 | 0.01 | 3.96 | 4.38 | — | — | — | — |
| | | | | Treated | 4.97 | 0.21 | 1.38 | 3.38 | 42 | 65 | 23 | — |
| VI | Iowa, Mahaska County (46g) | Salicylic Acid (18g) | 260° F.; 300 psig. $O_2$; 1 Hr.; Base: KOH - pHi-pHf (6.2–5.1) | Feed | 8.43 | 0.09 | 3.96 | 4.38 | — | — | — | — |
| | | | | Treated | 6.9 | 0.22 | 2.48 | 3.39 | 28 | 37 | 23 | 27 |
| VII | Pennsylvania, Pittsburgh Coal Bed (40g) | Dextrose (8.0g) | 260° F.; 320 psig. $O_2$; 1 Hr.; Base: KOH - pHi-pHf (8.0–3.4) | Feed | 2.98 | 0.14 | 1.68 | 1.16 | — | — | — | — |
| | | | | Treated | 2.17 | 0.01 | 0.84 | 1.32 | 27 | 50 | −14 | 7 |
| VIII | Upper Freeport Seam, Grantsville, Md. (30g) | Versene[2] (12g) | 260° F.; 320 psig. $O_2$; 1 Hr.; Base: None - pHi-pHf (10.6–7.4) | Feed | 2.59 | 0.04 | 1.75 | 0.80 | — | — | — | — |
| | | | | Treated | 0.88 | 0.01 | 0.19 | 0.68 | 66 | 89 | 15 | 6 |
| | Upper Freeport Seam, Grantsville, Md. (25.1g) | Phthalic Acid (12g) | 260° F.; 300 psig. $O_2$; 1 Hr.; Base: ROH - pHi-pHf (11.5–5.9) | Feed | 2.59 | 0.04 | 1.75 | 0.80 | — | — | — | — |
| | | | | Treated | 1.71 | 0.01 | 1.04 | 0.68 | 34 | 41 | 15 | 7 |

*Dry Ash Free Basis
[1]Sodium ethylenediamine tetraacetic acid
[2]Sodium N,N-di (2-hydroxyethyl) glycine

EXAMPLE III

When in Example I one of the following complexing agents are employed instead of sodium oxalate, the same or similar results are obtained in that the sulfur content of the coal is reduced: potassium oxalate, ammonium oxalate, sodium malonate, sodium glycinate, or sodium tripolyphosphate.

EXAMPLE IV

When in Example I the aqueous solution contains 0.2 M of an oxidant selected from the group consisting of peracetic acid, hydrogen peroxide or potassium superoxide instead of oxygen, the same or similar results are obtained in that sulfur content of the coal is reduced.

EXAMPLES V–IX

In the following Examples V to IX coal was ground and screened to provide a quantity of coal having a particle size of 100×325. Thirty grams of the coal employed and 200 ml. of an aqueous solution of iron complexing agent (and where indicated, base material) were charged to an autoclave forming a slurry. The autoclave was sealed and heated to the indicated temperature; oxygen was then introduced and maintained at the indicated pressure for the indicated time. The slurry is then filtered to separate the coal and the aqueous solution. The various coals, complexing agents, process condition and results obtained are presented in Table 2. In that table, the abbreviation T.S. means total sulfur; S.S. means sulfate sulfur; P.S. means pyritic sulfur; O.S.

EXAMPLE X

The following example is provided to demonstrate the improvement in selectivity of oxidation of sulfur compounds in coal that is achieved when employing an iron chelating agent in accordance with the invention.

Bon Aire Tennessee coal was ground and screened to provide a quantity of coal having a particle size of less than 100 mesh. The ground coal was divided into two portions.

Part A

One portion of coal was treated in the following manner to reduce its sulfur content. Thirty grams (wet basis) of this coal and 200 ml. of water was charged to an autoclave forming a slurry. The autoclave was sealed and then heated to 250° F.; oxygen was then introduced to the autoclave and maintained at a pressure of 300 psig $O_2$. The coal was held under these conditions for two hours, and then filtered to separate the coal and the aqueous solution. The coal was then dried. The resulting coal product is designated Product A. Since no iron chelating agent was employed, this sulfur removal method is not in accordance with the invention, but is provided for comparative purposes.

Part B

The other portion of coal was treated in the manner employed in Part A except that an aqueous solution of iron complexing agent (0.1 M sodium oxalate) was employed instead of water in accordance with the invention.

In this method the coal was held under treatment conditions for only about 55 minutes. In Part A two hours were required to achieve substantially similar pyritic sulfur removal. The resulting coal product is designated Product B.

The moles of $O_2$ consumed in the course of the process employed in Part A and B were measured in order to determine the "oxygen efficiency".

The sulfur content of the feed coal, the sulfur content of Product A, the sulfur content of Product B and the oxygen efficiency of the processes employed in Part A and Part B are shown in Table III below.

TABLE III

| Coal | % Total Sulfur | % Sulfur Type* | | | Oxygen Efficiency |
|---|---|---|---|---|---|
| | | Sulfate | Pyrite | Organic | |
| Feed | 4.02 | 0.02 | 1.86 | 2.14 | — |
| Product A | 2.40 | 0.11 | 0.14 | 2.15 | 0.53 |
| Product B | 1.99 | 0.02 | 0.12 | 1.74 | 1.11 |

*Dry ash free basis

In order to provide an indication of the selectivity of oxidation the oxygen efficiency of each process was determined. The oxygen efficiency is a measure of the amount of oxygen consumed in relation to the amount of sulfur removed and is defined as follows:

$$\text{Efficiency of } O_2 \text{ Utilization} = \frac{\text{Gr. Atom Sulfur Removed Based on Total Sulfur} \times 1.88}{\text{Moles of } O_2 \text{ Consumed in the Reaction}}$$

The factor 1.88 is originated from stoichiometry of pyrite oxidation in accordance with the equation shown below.

$$FeS_2+15O_2+2H_2O2Fe_2(SO_4)_3+2H_2SO_4O_2/S=1.88$$

As can be seen in Table III the oxygen efficiency of Part B, an example of the process of the invention, is significantly greater than the process employed in Part A which did not employ an iron chelating agent in accordance with the invention. High oxygen efficiency indicates a preferential oxidation of sulfur, and improved selectivity of oxidation of sulfur compounds in the coal.

Another advantage of the invention is also shown in this comparative example, namely, the rate of sulfur removal increased. In Part A, two hours were required to achieve the sulfur removals obtained. In Part B, only 55 minutes were required to achieve somewhat better sulfur removals.

As can been seen, the process of the invention employing an iron chelating agent provides a significant improvement over processes not employing an iron chelating agent in that sulfur removal proceeds more rapidly.

What is claimed is:

1. A process for reducing the pyritic sulfur content of coal comprising:

(1) contacting coal particles with an aqueous solution of iron complexing agent, and an oxidant at elevated temperature; and (2) recovering coal particles of reduced sulfur content.

2. The process of claim 1 wherein the recovered coal is metallurgical coal.

3. The process of claim 2 wherein the oxidant is oxygen.

4. The process of claim 3 wherein the oxygen is maintained at a pressure of from 5 to 500 psig.

5. The process of claim 4 wherein the temperature is from about 150° F. to 400° F.

6. The process of claim 5 wherein the iron complexing agent is present in a mole ratio of iron complexing agent to pyrite of 0.05 to 10.

7. The process of claim 6 wherein the iron complexing agent is a compound which forms ferrous or ferric complexes having a stability constant-log K of more than 1.

8. The process of claim 7 wherein the stability constant-log K is greater than 2.

9. The process of claim 8 wherein the pressure of oxygen is from about 25 to 400 psig.

10. The process of claim 9 wherein the pressure of oxygen is from about 50 to 300 psig.

11. The process of claim 10 wherein the temperature is from about 175° F. to 350° F.

12. The process of claim 11 wherein the complexing agent is selected from the group consisting of carboxylic acids and carboxylic acid salts, diols and polyols, amines, amino acids and amino acid salts, amino polycarboxylic acids and amino polycarboxylic acid salts, phosphonic acids and phosphonic acid salts, condensed phosphates, and salts of condensed phosphates.

13. The process of claim 12 wherein the salts are alkali metal and ammonium salts.

14. The process of claim 13 wherein the complexing agent is selected from the group consisting of sodium oxalate, potassium oxalate and ammonium oxalate.

15. The process of claim 2 wherein the oxidant is selected from the group consisting of ozone and singlet oxygen.

16. The process of claim 2 wherein the oxidant is an organic oxidant selected from the group consisting of hydrocarbon peroxides, hydrocarbon hydroperoxides and hydrocarbon peracids.

17. The process of claim 2 wherein the oxidant is an inorganic oxidant selected from the group consisting of peroxides and superoxides.

18. The process of claim 17 wherein the oxidant is hydrogen peroxide.

* * * * *